United States Patent [19]

Deininger et al.

[11] Patent Number: 4,733,533

[45] Date of Patent: Mar. 29, 1988

[54] CONTROLS FOR POWER DRIVE ASSEMBLIES

[75] Inventors: Horst Deininger, Horstein/Alzenau; Walter Kropp, Sulzbach am Main, both of Fed. Rep. of Germany

[73] Assignee: Linde Aktiengesellschaft, Wiesbaden, Fed. Rep. of Germany

[21] Appl. No.: 718,982

[22] Filed: Apr. 2, 1985

[30] Foreign Application Priority Data

Apr. 5, 1984 [DE] Fed. Rep. of Germany ..... 3412871

[51] Int. Cl.[4] ..... F15B 11/16; F15B 11/20

[52] U.S. Cl. ..... 60/431; 60/422; 60/423; 60/428; 60/430

[58] Field of Search ..... 60/431, 445, 423, 422, 60/428, 430; 417/34, 45, 216, 219

[56] References Cited

U.S. PATENT DOCUMENTS 4,070,857 1/1978 Wible ..... 60/422
4,118,149 10/1978 Hagberg ..... 60/431 X
4,379,389 4/1983 Liesener ..... 417/216 X
4,523,431 6/1985 Budzich ..... 60/423 X
4,549,400 10/1985 King ..... 60/431 X

FOREIGN PATENT DOCUMENTS 2363480 6/1975 Fed. Rep. of Germany ..... 417/219

*Primary Examiner*—Edward K. Look
*Attorney, Agent, or Firm*—Buell, Ziesenheim, Beck & Alstadt

[57] ABSTRACT

A control for a power drive assembly having a primary energy source, a hydrostatic pump driven by the energy source and a consumer of energy has a multiway valve between the pump and consumer and a control pressure dependent valve receiving fluid from the pump controlling its position and connections between a source of pressure fluid and a spring biased operating cylinder connected to a control lever on the primary energy source controlling operation thereof.

14 Claims, 6 Drawing Figures

CONTROLS FOR POWER DRIVE ASSEMBLIES

This invention relates to controls for power drive assemblies and more particularly to a control for a drive aggregate or power package that consists of a primary energy source, preferably an internal combustion machine, and a hydrostatic pump driven by it and a consumer of hydrostatic energy loaded by it, in which an arbitrarily actuatable multiway valve throttling in the intermediate positions is located between the pump and the consumer and the pressure in front this multiway valve acts on a control pressure chamber of a control pressure-dependent valve and the pressure beyond the multiway valve acts on the second, spring-side control pressure chamber of this valve, to the inlet of which a control pressure medium source is connected and to whose outlet an operating cylinder is connected, in which a servo piston is capable of sliding against the force of a spring.

In a familiar prior art arrangement of this type, the consumer is a dredger controlled by several cylinders, where the control takes place through the multiway valve, and the operating cylinder is the operating cylinder of the pump, which loads the consumer (DE-OS No. 30 44 144). This is a very advantageous and expedient solution, in which however the regulating element of the internal combustion engine is not affected by the power consumption of the Pump. Such load-sensing systems pursue the goal of adapting the pressure medium stream generated to the requirement of the consumer. That has basically occurred to date only through the fact that the stroke volume of the adjustable pump at its prescribed r.p.m. is adapted to the need.

On the other hand, it is known in the case of fork lifts that a pump is driven by the internal combustion engine and it loads the lifting cylinder of the lift apparatus through an arbitrarily actuatable valve, in which case the regulating element of the internal combustion engine is connected through mechanical members with the actuating lever, by which the multiway valve is actuated to control the lifting cylinder (DE-PS No. 15 26 528). This mechanical coupling is very expensive because the actuating lever must be located within reach of the driver, while the regulating element of the internal combustion engine is located below the driver. The result is that a certain force is required for actuating the multiway valve and a second certain force is also required to adjust the regulating element of the internal combustion engine, in which case these two forces add up to a value that is unpleasant for the attendant. In addition, consumers other than the lifting cylinder, e.g., the tilting cylinder, are loaded by the pump and are controlled through a multiway valve, in which case the energy absorbed by the individual consumers is different and consequently during actuation of the one multiway valve a different setting is assigned to the regulating element of the internal combustion engine, as compared with that during the actuation of another multiway valve. This makes the mechanical connecting members particularly expensive.

In a fork lift with a hydrostatic power transmission in the travel drive, which is regulated by means of an arbitrarily actuatable control pressure pick-off, it is already known to connect the regulating element of the internal combustion engine with a servo piston that is capable of shifting against the force of a spring in an operating cylinder, which is influenced either by the control pressure that determines the setting of the hydrostatic power transmission in the travel drive, or in another switching state by the control pressure that is generated by another control pressure pick-off that is connected with the actuating lever for actuating advantageous arrangement, but it still has the shortcoming that a separate control pressure pick-off must be connected with the actuating lever. This arrangement is also to be improved by the present invention, so that the present invention thus also concerns a control for a drive aggregate or power package that consists of a primary energy source, preferably an internal combustion engine, and a hydrostatic pump driven by it and a hydrostatic energy consumer loaded by the latter, in which the regulating element of the primary energy source is connected with a servo piston capable of sliding in an operating cylinder against the force of a spring, in which case the operating cylinder is loaded by a control pressure that is dependent on the regulation of the hydraulic energy consumer.

The invention proposes to control the regulating element of the primary energy source in a favorable manner at a slight structural expense, as a function of the regulation of the hydraulic energy consumer, and to achieve further advantages in so doing.

According to the invention, this goal is achieved in that the spring-loaded servo piston, which is capable of sliding in the operating cylinder loaded by the valve controlled as a function of the pressure in front of and beyond the multiway valve, is connected with the regulating element of the primary energy source. It is thus achieved according to the invention that the multiway valve, besides its function relative to regulating the stream flowing to the consumer, is also designed by means of the pressure-dependent valve as a regulating element for the primary energy source, thus assumes a second function, namely the function of regulating the primary energy source, i.e., that the operating cylinder for the final control element of the primary energy source, whose pressure loading is controlled by the valve that is regulated as a function of the pressure in front of and beyond the multiway valve serving as the setting means, if the delivery stream of the pump is smaller than the stream required by the setting imposed on the multiway valve, is connected with a pressure medium source, so that the primary energy source is set to a higher r.p.m. or vice versa if the delivery stream of the pump relative to the setting of the multiway valve is too large, the operating cylinder is connected with a drain line. The signal, the use of which for regulating the stroke volume of the pump per revolution has been known to date, is thus used according to the invention (especially in a hydrostatic arrangement with a constant pump) to regulate the r.p.m. of the primary energy source.

Relative to the state of the art known through DE-OS No. 30 44 144, it means that the servo piston is connected in the familiar operating cylinder, which is regulated in a familiar manner, with the regulating element of the primary energy source, or relative to the state of the art known through DE-OS No. 30 35 152 it means that the operating cylinder in which the servo piston connected with the regulating element of the internal combustion engine is capable of sliding is connected to the outlet of the valve that is controlled as a function of pressure, in which case the pressure in front of and beyond the arbitrarily regulatable multiway valve acts on the two control pressure chambers of this valve. According to the invention, adaptation of the stream delivered by the pump to the need of the consumer is effected by regulating the drive r.p.m., so that a constant pump can also be used. The stream flowing through the multiway valve to the consumer is always regulated so that the pressure gradient that is prescribed by the force of the spring at the pressure-dependent valve arises as a result of the throttling in this multiway valve, i.e., is thus required by the setting of the multiway valve.

Such an arrangement can be prepared with relatively little cost. The disadvantages of regulating the primary energy source by mechanical members is eliminated. Through the regulation according to the invention, no additional force arises at the actuating lever with which the multiway valve is actuated. The arrangement is practically almost wear-free and cost-favorable fitting is readily possible. Nor is there any difficulty in shaping the control characteristics so that the r.p.m. of the internal combustion engine provided as the primary energy source is kept as low as possible such that precisely the delivery stream required of the pump, which can be designed as a constant pump in this case, is achieved. It is thus directly possible to undertake the regulation so that an excessive oil stream is produced and must be removed in a throttled manner. In addition, the arrangement can be laid out so that when the multiway valve is returned to the neutral position, in which no energy is delivered by the pump to the hydraulic energy consumer, the r.p.m. of the primary energy source is reduced, i.e., the internal combustion engine is set to the idling r.p.m. In addition to the function known from DE-OS No. 30 44 144, it can be provided that the pressure-dependent valve is also designed to emit a signal when the delivery stream is too low and in this case increases the r.p.m. of the primary energy source and is also designed for resetting the regulating element of the primary energy source when the work movement is completed.

At least three different pressure medium sources are possible for extracting the signal; they facilitate an organization of the control loop members with and without compensation. The design according to the invention also facilitates a coupling of a pressure-relief valve through the spring of the pressure-dependent valve. Application is possible not only in fork lifts, but also in other drive systems, preferably in commercial vehicles or navigable equipment, in which the primary energy source drive hydraulically driven systems in addition to the travel drive, e.g., in wheeled loaders or scoop loaders, etc.

Three different implementation examples of the object of invention are shown in the drawings in circuit diagrams.

In the foregoing general description I have set out certain objects, purposes and advantages of this invention. Other objects, purposes and advantages of this invention will be apparent from a consideration of the following description and the accompanying drawings in which.

Figure 1:
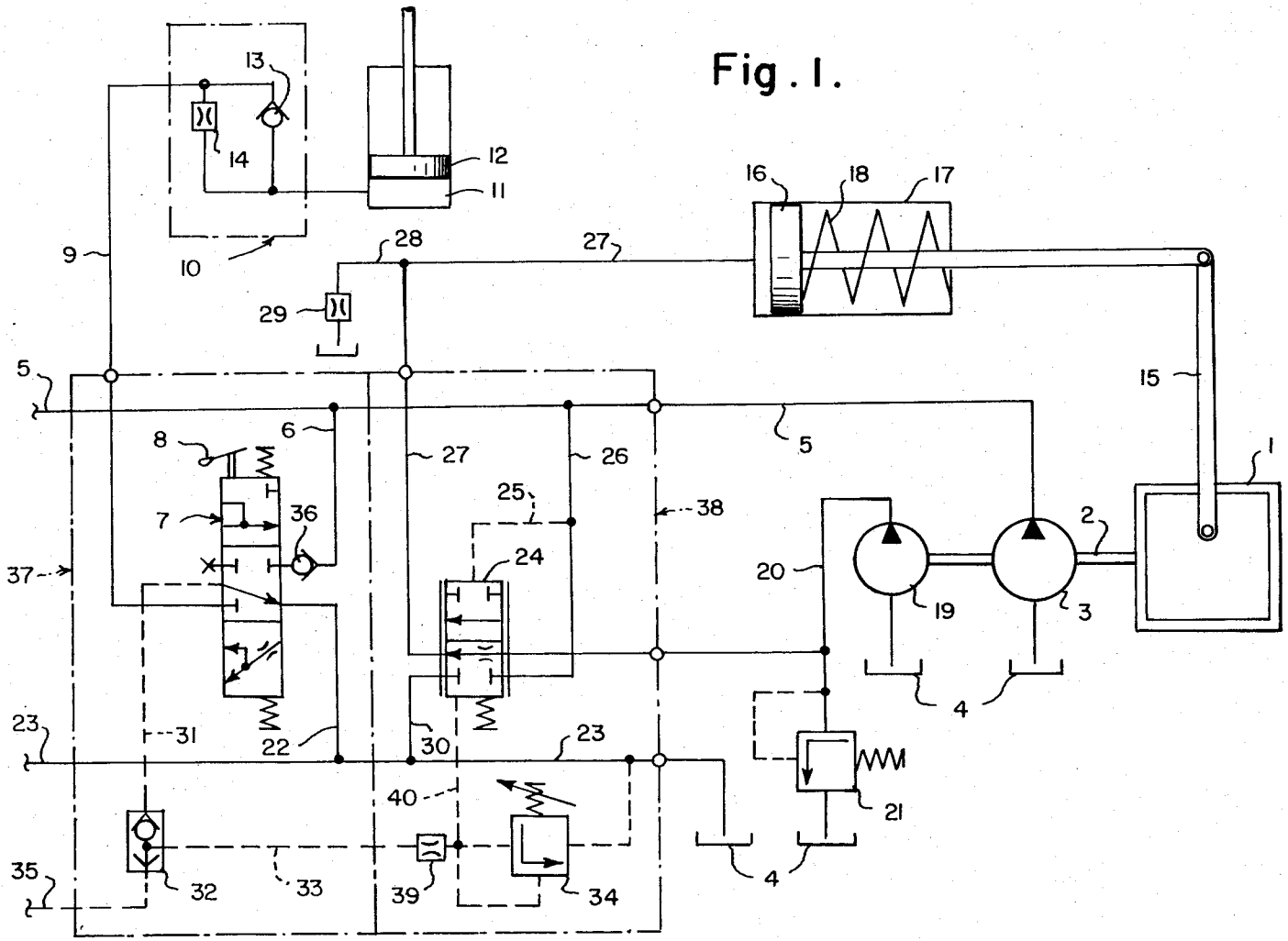
FIG. 1 is a schematic drawing of one embodiment of this invention with an additional pump as the pressure medium source.

Referring to the drawings, the internal combustion engine 1 drives the constant pump 3 through the shaft 2. Pump 3 draws from a tank 4 and delivers into a feed line 5, from which a branch line 6 leads to a multiway valve 7 that can be arbitrarily regulated by an actuating lever 8. A feed line 9 is connected to an outlet of this multiway valve 7 and it leads through a lowering braking valve 10 to the cylinder 11 provided as the consumer, in which a piston 12 is capable of sliding and which serves to raise a load (not shown in the drawing).

A check valve 13 and a restrictor 14 are connected in parallel in the lowering brake valve 10, such that the full stream can flow through unhindered for raising the piston 12, while the lowering of the piston 12 takes place slowly through the restrictor 14.

The regulating element of the internal combustion engine 1 is connected with an adjustable lever 15, which is connected with a servo piston 16 that is capable of sliding in an operating cylinder 17 against the force of a spring 18.

The multiway valve 7 is connected with a second line 22 on the inlet side; line 22 empties into a line 23 that leads to the pressureless tank 4.

An auxiliary constant pump 19 is also connected to the shaft 2 of the internal combustion engine 1. A relief-valve jet 21 is connected to the control pressure feed line 20 of the pump 19; it assures that a constant pressure is maintained in the control pressure feed line 20. This line 20 leads to an inlet connection of a pressure-dependent valve 24, one control pressure chamber of which is loaded through a line 25, which is in turn connected through the line 26 to the feed line 5, in which case the line 26 in turn leads to the second inlet connection of the pressure-dependent valve 24. A line 27 is connected to an outlet of the pressure-dependent valve 24; it leads to the operating cylinder 17 and a drain line 28 is connected to it. A restrictor 29 is located in the line 28 and pressure medium can flow off continuously through it so that the setting of the servo piston 16 is determined by a continuous regulation of an equilibrium state. A line 30 is connected to the second outlet connection of the pressure-dependent valve 24 and is also connected to the line 23 leading to the tank 4.

A control pressure line 31 is connected to one outlet of the multiway valve 7 and it leads to a pressure-dependent reversing valve 32. A control pressure line 33 is connected to the outlet of this valve 32 and it leads through the line 40 to the spring-side control pressure chamber of the pressure-dependent valve 24.

An arbitrarily adjustable relief-valve jet 34 is connected to the line 33/40 as an additional possibility for influence.

A line 35 is connected to the second inlet of the reversing valve 32 and it leads to the control pressure lines of a multiway valve (not shown), which corresponds in principle to the multiway valve 7 and is assigned to another consumer.

A by-pass check valve 36 is also incorporated into the line 6.

The multiway valve 7 is located in a housing 37 and the pressure-dependent valve 24 is located in a housing 38, together with the relief-valve jet 34.

The mode of operation is as follows: in the switching state shown in the drawing the multiway valve 7 is placed by means of the actuating lever 8 in the neutral position in which the multiway valve 7 shuts off the line 6. The cylinder 11 receives no delivery stream. The stream delivered by the pump 3 into the feed line 5 can flow through the left-hand connection in the drawing to consumers or valves (not shown), or is returned through the pressure-dependent valve 24, 44, 54 through the line 30 to the tank 4 if no consumer is actuated.

Now if the multiway valve 7 or another of like type, assigned to another consumer, is shifted by means of the actuating lever 8 so that it connects the line 6 in a throttled manner with the line 9, the pressure prevailing in the line 9 simultaneously communicates in this switching state with line 31 and thus also prevails in the line 33 and thus also in the spring-side control pressure chamber of the pressure-dependent valve 24. If the pressure difference between the pressures in the lines 26 and 33 is greater than the difference prescribed by the spring of the pressure-dependent valve 24, the latter valve 24 interrupts the connection of the control pressure feed line 20 with the line 27 so that the operating cylinder 17 remains unaffected and thus the regulating element of the internal combustion engine 1 also remains in an unchanged setting. If the pressure gradient between the lines 26 and 33 and thus the pressure difference before and after the metering restrictor in the multiway valve 7 is less than the value determined by the spring at the pressure-dependent valve 24, the valve 24 connects the line 20 with the line 27 so that the pressure medium is fed from the control pressure feed line 20 into the line 27 and adjusts the servo piston 16 toward regulating the internal combustion engine to a higher r.p.m. The connection of the feed line 5 is thus simultaneously interrupted.

If a higher pressure prevails in the control pressure line 35 than in the control pressure line 31, the reversing valve 32 connects the lines 35 and 33 together, with the result that the pressure-dependent valve 24 is now regulated by the pressure in the control pressure line 35.

In the third switching position of the multiway valve 7, it connects both line 9 and line 31 with the tank so that on the one hand pressure medium is released from the cylinder 11 and on the other hand pressure is also released from the spring-side control pressure chamber of the valve 24, so that the latter in turn closes off the lines 20 and 27 and connects the line 26 with the line 30 leading to the tank 4.

The restrictor 39 slows down a backflow from the line 33 if the pressure is lowered in the line 40 through the relief-valve jet 34.

Figure 3:
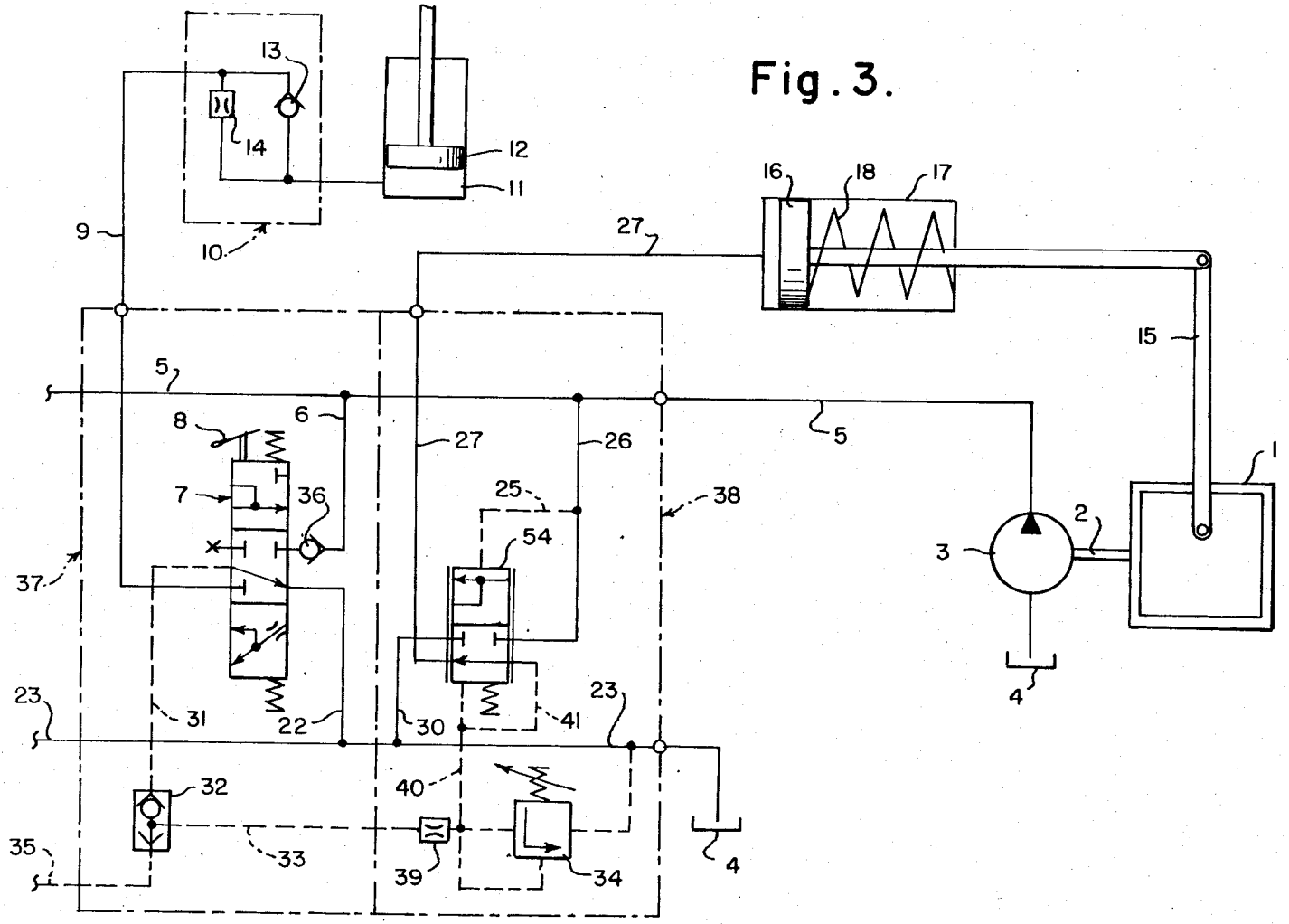
FIG. 3 is a schematic drawing of a third embodiment in which the loading of the operating cylinder occurs from the load-signal stream of the consumer.

The embodiment according to FIG. 3 differs from that according to FIG. 1 only in that the auxiliary control pump drops out and the pressure-dependent valve 44 appears instead of the pressure-dependent valve 24. Valve 44 is provided only with one inlet connection to which line 26 is connected.

The mode of action is the same as in the embodiment according to FIG. 1, with the sole difference that a partial stream is branched off to load the operating cylinder 17 (the delivery stream of the auxiliary control pump 19 is not used, but) from the delivery stream of the pump 3 in the line 5 through the line 26 and is conveyed through the valve 44 into the line 27, provided the valve 44 assumes the switching position shown in the drawing.

Figure 2:
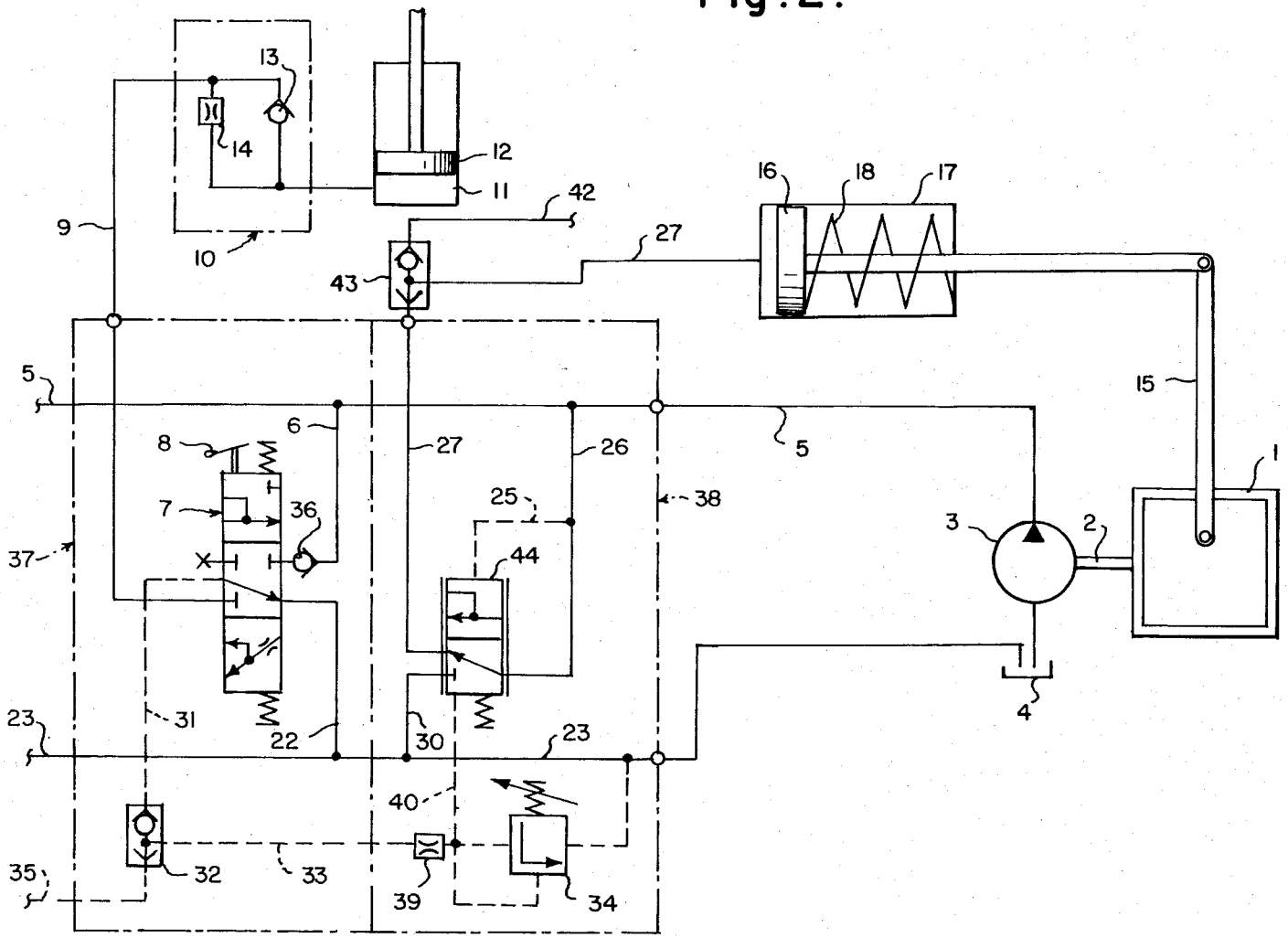
FIG. 2 is a schematic drawing of a second embodiment in which the hydraulic energy required for loading the operating cylinder is branched off from the stream from the pump to the consumer.

The embodiment according to FIG. 3 differs from that according to FIGS. 1 and 2 in that instead of the valve 24 or the valve 4 it has the valve 54, which also has two inlet connections as valve 24. However, because an auxiliary control pump 19 is not provided in the embodiment according to FIG. 3, just as in the embodiment according to FIG. 2, a line 41 is connected to the second connection of the pressure-dependent valve 54 in the embodiment according to FIG. 3; it goes out from the line 40 so that the operating cylinder 11 is loaded through the lines 31, 33, 40 and 41 and 27 and in the other switching position of valve 54 the lines 26, 27 and 30 are relieved of pressure.

The fact that the internal combustion engine always runs with the lowest possible r.p.m. that is required to generate the fluid stream required causes the fuel consumption, exhaust gas and noise emissions and the energy losses due to throttling to be as low as possible. There is also a positive effect on the service life of the internal combustion engine. The multiway valve must in any case be present for regulating the consumer. The only additional expense results from the different design of the "pressure-scale" valve that is regulated as a function of the pressure gradient in the metering restrictor.

An embodiment is also shown in FIG. 2, in which the line departing from the pressure-dependent valve 44 leads to an inlet of a pressure-dependent reversing valve 43. The line lead to the operating cylinder 17 is connected to the outlet of valve 43 and a line 42 is connected to the second inlet of valve 43 and is in turn connected to the control pressure line (not shown) in which the control pressure is carried. This control pressure loads the operating cylinder of the pump (not shown) or of the hydrostatic motor (not shown) of the power transmission of the travel drive of the equipment into which the arrangement shown in the drawing is incorporated. An analogous connection is also possible in the embodiment according to FIGS. 1 or 3.

Figure 4:
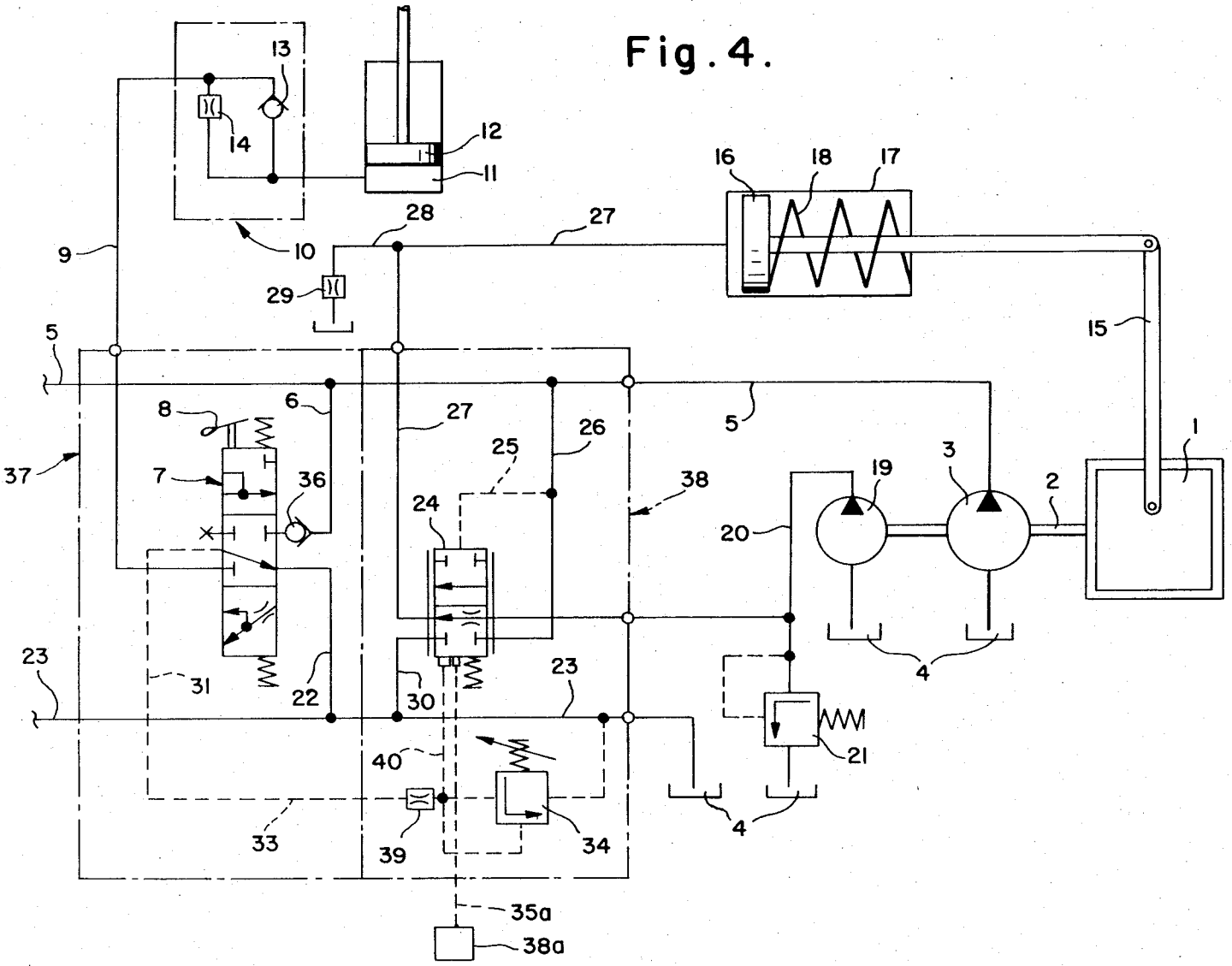
FIG. 4 is a schematic drawing illustrating the invention of FIG. 1 connected to a control pressure dependent valve of another drive.
Figure 5A:
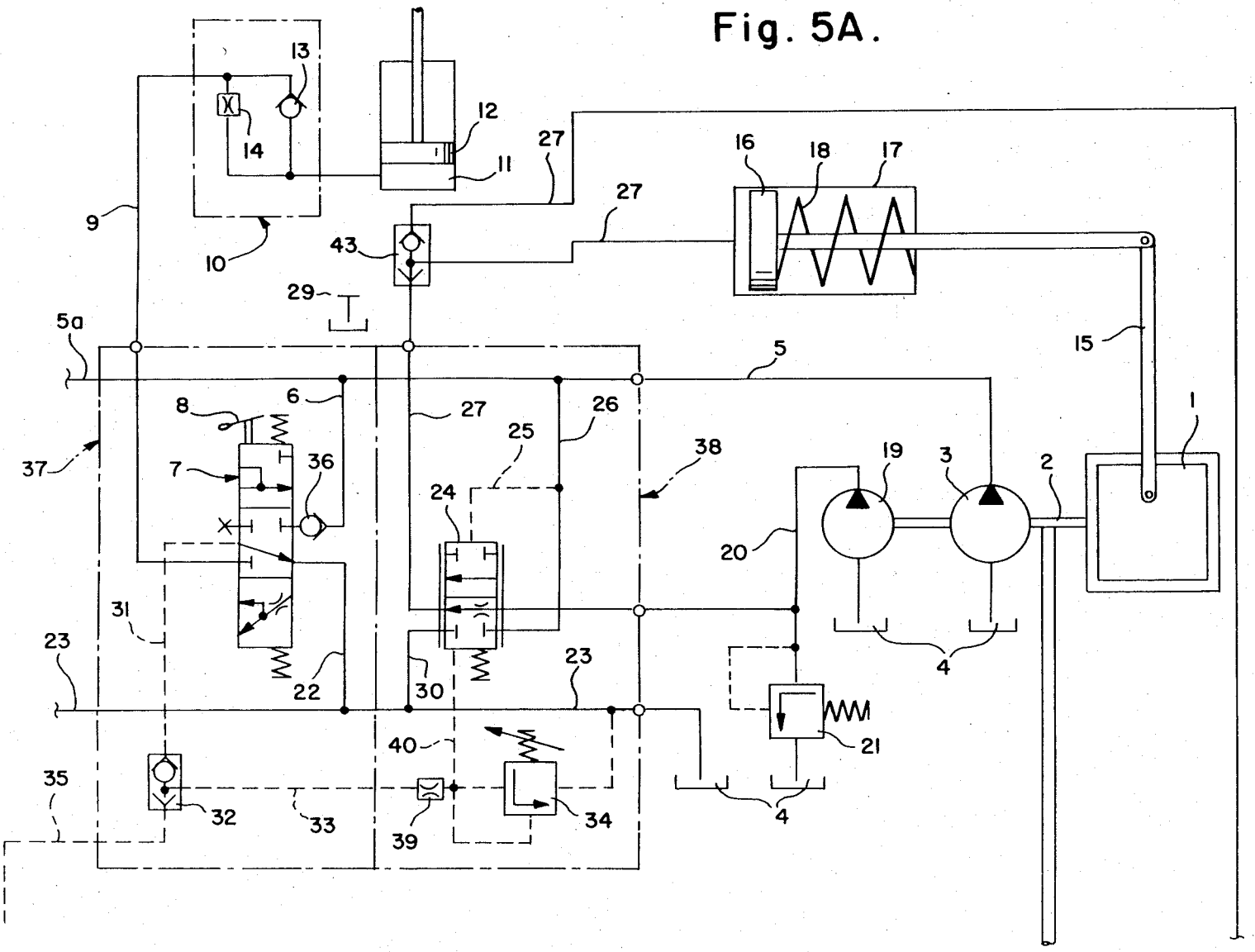
FIGS. 5A and 5B are a schematic drawing of the hydrostatic power transmission drive of the invention of FIG. 1 connected to the hydrostatic transmission drive.
Figure 5B:
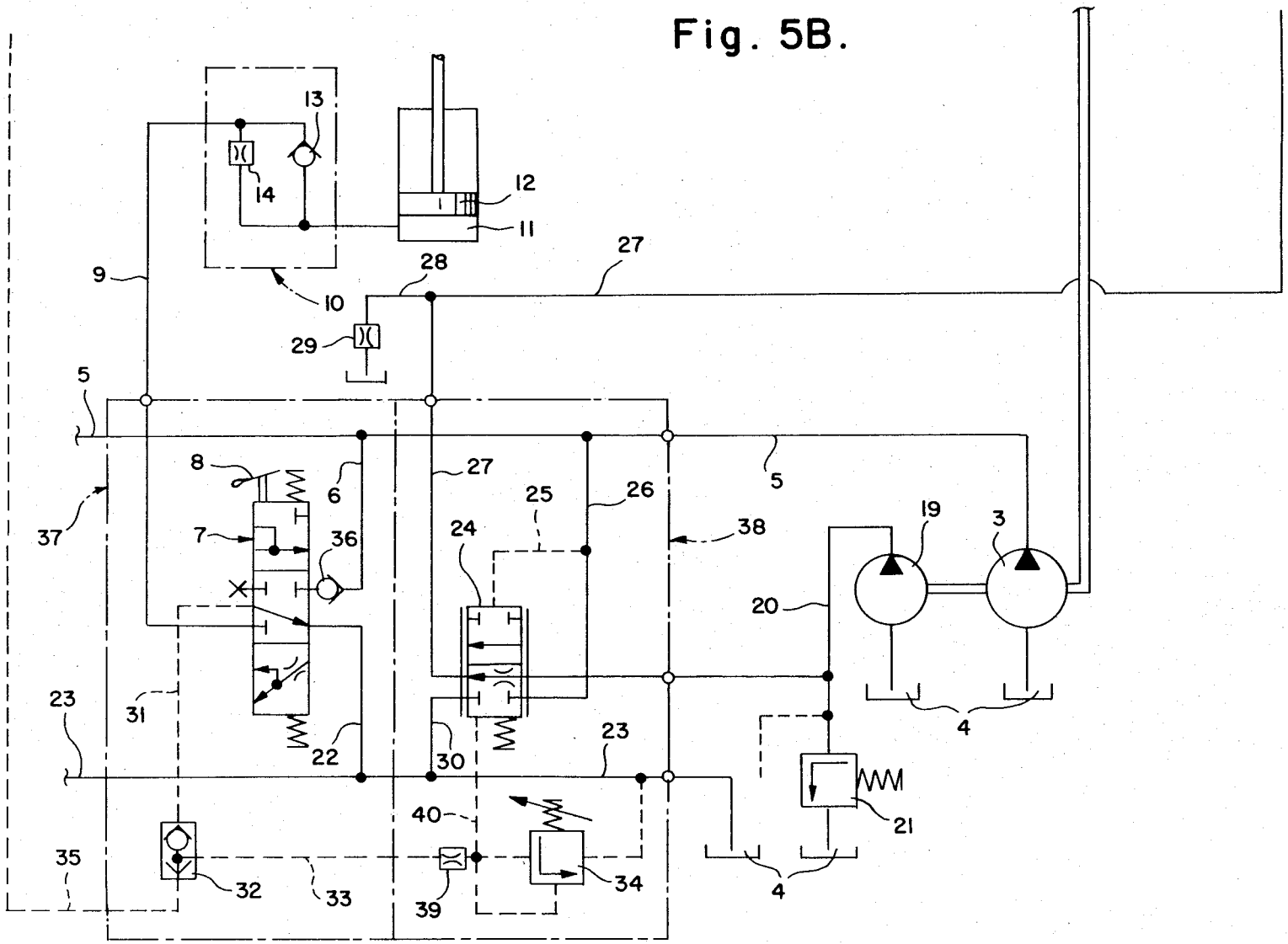

FIG. 4 illustrates the hydrostatic power transmission drive of FIG. 1 in which a second control pressure chamber at valve 24 is acted upon by **35*a* from a second system designated as the black box 38*a*. In FIGS. 5A and 5B there is illustrated a hydrostatic power drive system similar to that of FIG. 1 connected to a like hydrostatic drive system in which motor 1 drives both pumps 3, the two pressure dependent reversing valves 32 are conected together through line 35 and line 27 of each unit is connected to a two way check valve 43**.

In the foregoing specification we have set out certain preferred practices and embodiments of this invention, however, it will be understood that this invention may be otherwise embodied within the scope of the following claims.

We claim:

1. A power drive assembly and control therefor comprising a primary energy source, a hydrostatic pump driven by said energy source, a consumer of hydrostatic energy connected to and receiving fluid under pressure from said pump, a multiway valve between the pump and consumer for controlling the flow therebetween, said multiway valve providing a throttling effect in its intermediate position, a control pressure dependent valve having a first control pressure chamber connected between the pump and multiway valve and a second spring biased control chamber connected between the consumer and multiway valve whereby the first control chamber acted upon by the pressure in front of the multiway valve and the second control chamber is acted upon by pressure beyond the multiway valve, a fluid passage in said valve controlled by differential pressure in said first and second chambers, said passage connecting a control pressure inlet and outlet, a source for control pressure connected to said control pressure inlet, a control cylinder connected to the control pressure outlet, a biasing spring in said control cylinder acting in opposition to control fluid delivered from said control pressure dependent valve, an adjusting element on the primary energy soure and a connection between said adjusting element and a moving element of the control cylinder on the side opposite the connection with the control pressure valve and wherein the fluid passage of the control pressure dependent valve receive fluid from the connection between the multiway valve and consumer of hydrostatic energy for delivery to the operating cylinder.

2. A power drive assembly and control therefor comprising a primary energy source, a hydrostatic pump driven by said energy source, a consumer of hydrostatic energy connected to and receiving fluid under pressure from said pump, a multiway valve between the pump consumer for controlling the flow therebetween, said multiway valve providing a throttling effect in its intermediate position, a control pressure dependent valve having a first control pressure chamber connected between the pump and multiway valve and a second spring biased control chamber connected between the consumer and multiway valve whereby the first control chamber acted upon by the pressure in front of the multiway valve and the second control chamber is acted upon by pressure beyond the mulltiway valve, a fluid passsage in said valve controlled by differential pressure in said first and second chambers, said passage connecting a control pressure inlet and outlet, a source of control pressure connected to said control pressure inlet, a control cylinder connected to the control pressure outlet, biasing spring in said control cylinder acting in opposition to control fluid delivered from said control pressure dependent valve, an adjusting element on the primary energy source and a connection between said adjusting element and a moving element of the control cylinder on the side opposite the connection with the control pressure valve and wherein pressure dependent reversing valve is connected between a parallel connection formed from a control pressure line of another drive and the multiway valve and the second chamber of the pressure dependent valve.

3. A control as claimed in claim 2 wherein control pressure medium source is an auxiliary pump.

4. A control as claimed in claim 2 wherein the control pressure medium source is the hydrostatic pump.

5. A control as claimed in claim 2 wherein the fluid passages of the control pressure dependent valve receives fluid from the connection between the multiway valve and consumer of hydrostatic energy for delivery to the operating cylinder.

6. A control according to claim 2, or 3, or 4, or 5 wherein the control pressure line of another drive is connected to a second chamber of a control pressure dependent valve of another drive.

7. A control according to claim 6 wherein a pressure dependent reversing two way valve is provided having one inlet receiving fluid from the pressure dependent valve and delivering fluid to the operating cylinder, a hydrostatic transmission drive and a second inlet connected to a control pressure line which determines the setting of the hydrostatic power transmission drive unit.

8. A control according to claim 2, or 3, or 4, or 5 wherein a pressure dependent reversing two way valve is provided having one inlet receiving fluid from the pressure dependent valve and delivering fluid to the operating cylinder, a hydrostatic transmission drive and a second inlet connected to a control pressure line which determines the setting of the hydrostatic power transmission drive unit.

9. A power drive asssembly and control therefor comprising a primary energy source, a hydrostatic pump driven by said energy source, a consumer of hydrostatic energy connected to and receiving fluid under pressure from said pump, a multiway valve between the pump and consumer for controlling the flow therebetween, said multiway valve providing a throttling effect in its intermediate position, a control pressure dependent valve having a first control pressure chamber connected between the pump and multiway valve and a second spring biased control chamber connected between the consumer and multiway valve whereby the first control chamber acted upon by the pressure in front of the multiway valve and the second control chamber is acted upon by pressure beyond the multiway valve, a fluid passage in said valve controlled by differential pressure in said first and second chambers, said passage connecting a control pressure inlet and outlet, a source of control pressure connected to said control pressure inlet, a control cylinder connected to the control pressure outlet, a biasing spring in said control cylinder acting in opposition to control fluid delivered from said control pressure dependent valve, an adjusting element on the primary energy source and a connection between said adjusting element and a moving element of the control cylinder on the side opposite the connection with the control pressure valve and wherein a pressure dependent reversing two way valve is provided having one inlet receiving fluid from the pressure dependent valve and delivering fluid to the operating cylinder, a hydrostatic transmission drive and a second inlet connected to a control pressure line which determines the setting of the hydrostatic power transmission drive unit.

10. A control as claimed in claim 9 wherein control pressure medium source is an auxiliary pump.

11. A control as claimed in claim 10 wherein the auxiliary pump is driven by the primary energy source.

12. A control as claimed in claim 9 wherein the control pressure medium source is the hydrostatic pump.

13. A control as claimed in claim 9 wherein the fluid passage of the control pressure dependent valve receives fluid from the connection between the multiway valve and consumer of hydrostatic energy for delivery to the operating cylinder.

14. A power drive assembly and control therefor comprising a primary energy source, a constant displacement hydrostatic pump driven by said energy source, a consumer of hydrostatic energy connected to and receiving fluid under pressure from said pump, a multiway valve between the pump and consumer for controlling the flow therebetween, said multiway valve providing a throttling effect in its intermediate position, a control pressure dependent valve having a first control pressure chamber connected between the pump and multiway valve and a second spring biased control chamber connected between the consumer and multiay valve whereby the first control chamber is acted upon by the pressure in front of the multiway valve and the second control chamber is acted upon by pressure beyond the multiway valve, a fluid passage in said valve controlled by differential pressure in said first and second chambers, said passage connecting a control pressure inlet and outlet, an auxiliary constant displacement pump supplying control pressure connected to said control pressure inlet, a control cylinder connected to the control pressure outlet, a biasing spring in said control cylinder acting in opposition to control fluid delivered from said control pressure dependent valve, an adjusting element on the primary energy source and a connection between said adjusting element and a moving element of the control cylinder on the side opposite the connection with the control pressure valve wherein the control pressure medium source is the hydrostatic pump and the auxiliary pump is driven by the primary energy source and wherein a pressure dependent reversing two way valve is provided having one inlet receiving fluid from the pressure dependent valve and delivering fluid to the operating cylinder, a hydrostatic transmission drive and a second inlet connected to a control pressure line which determines the setting of the hydrostatic power transmission drive unit.

* * * * *

UNITED STATES PATENT AND TRADEMARK OFFICE

CERTIFICATE OF CORRECTION

PATENT NO. : 4,733,533

DATED : March 29, 1988

INVENTOR(S) : Horst Deininger et al. and Walter Kropp

It is certified that error appears in the above-identified patent and that said Letters Patent is hereby corrected as shown below:

Column 2, line 5, after "for actuating" insert --another arrangement (DE-OS 30 35 152). This is also a very--.

Column 7, line 10, change "for" to --of--.

Column 7, line 15, change "soure" to --source--.

Column 7, line 20, change "receive" to --receives--.

Column 7, line 27, after "the pump" insert --and--.

Column 7, line 37, change "mulltiway" to --multiway--.

Column 7, line 43, after "outlet," insert --a--.

Column 7, line 49, after "wherein" insert --a--.

Signed and Sealed this

Eighth Day of November, 1988

*Attest:*

*Attesting Officer*

DONALD J. QUIGG

*Commissioner of Patents and Trademarks*